US011882974B2

(12) United States Patent
An

(10) Patent No.: US 11,882,974 B2
(45) Date of Patent: Jan. 30, 2024

(54) ULTRASONIC SPOON WASHING APPARATUS AND METHOD

(71) Applicant: Hi Ok An, Seoul (KR)

(72) Inventor: Hi Ok An, Seoul (KR)

( * ) Notice: Subject to any disclaimer, the term of this patent is extended or adjusted under 35 U.S.C. 154(b) by 259 days.

(21) Appl. No.: 17/608,625

(22) PCT Filed: Apr. 23, 2020

(86) PCT No.: PCT/KR2020/005374

§ 371 (c)(1),
(2) Date: Nov. 3, 2021

(87) PCT Pub. No.: WO2020/226307

PCT Pub. Date: Nov. 12, 2020

(65) Prior Publication Data

US 2022/0211244 A1 Jul. 7, 2022

(30) Foreign Application Priority Data

May 9, 2019 (KR) ..... 10-2019-0054419

(51) Int. Cl.
*A47L 15/13* (2006.01)
*A47L 15/00* (2006.01)
(Continued)

(52) U.S. Cl.
CPC ..... *A47L 15/13* (2013.01); *A47L 15/0028* (2013.01); *A47L 15/16* (2013.01); *A47L 15/33* (2013.01);
(Continued)

(58) Field of Classification Search
CPC ..... A47L 15/13; A47L 15/0028; A47L 15/16; A47L 15/33; A47L 15/4223;
(Continued)

(56) References Cited

U.S. PATENT DOCUMENTS

2022/0211244 A1* 7/2022 An ..... A47L 15/4223

FOREIGN PATENT DOCUMENTS

CN 206414246 U 8/2017
GB 2518477 A * 3/2015 ..... B08B 3/045
(Continued)

OTHER PUBLICATIONS

Machine Translation of KR101166436B1 (Year: 2012).*

*Primary Examiner* — Sharidan Carrillo
(74) *Attorney, Agent, or Firm* — John K. Park; PARK LAW FIRM

(57) ABSTRACT

Proposed is ultrasonic spoon washing apparatus and method, which use ultrasonic waves generated by one or more ultrasonic oscillators provided on a vertical side wall of polygonal surfaces of a wash tub, so that spoons contained in a spoon support part rotating forward/in reverse may very efficiently and conveniently be washed while the number of revolutions changes for each washing stage, the apparatus including: a frame body; the wash tub mounted inside the frame body; one or more ultrasonic oscillators provided on an outer side of the vertical side wall; a forward/reverse rotation support part including a support shaft and a rotation support pipe; a spoon support part including a holder and a spoon accommodation container; a rinsing water supply part configured to spray the rinsing water together with a rinsing aid; and a wastewater and foreign material discharge part configured to discharge, to the outside, wastewater and foreign materials.

1 Claim, 15 Drawing Sheets

(51) Int. Cl.

| | |
|---|---|
| ***A47L 15/16*** | (2006.01) |
| ***A47L 15/33*** | (2006.01) |
| ***A47L 15/42*** | (2006.01) |
| ***A47L 15/50*** | (2006.01) |

(52) U.S. Cl.
CPC ..... *A47L 15/4223* (2013.01); *A47L 15/4244* (2013.01); *A47L 15/4285* (2013.01); *A47L 15/502* (2013.01); *A47L 2401/09* (2013.01); *A47L 2401/12* (2013.01); *A47L 2601/17* (2013.01)

(58) Field of Classification Search
CPC ..... A47L 15/4244; A47L 15/4285; A47L 15/502; A47L 2401/09; A47L 2401/12; A47L 2601/17
See application file for complete search history.

(56) References Cited

FOREIGN PATENT DOCUMENTS

| | | | |
|---|---|---|---|
| KR | 20-1991-0017838 | U | 11/1991 |
| KR | 10-2006-0085977 | A | 7/2006 |
| KR | 10-2007-0062295 | A | 6/2007 |
| KR | 10-0753389 | B1 | 8/2007 |
| KR | 10-2050696 | B1 | 11/2019 |

* cited by examiner

[Fig. 1]
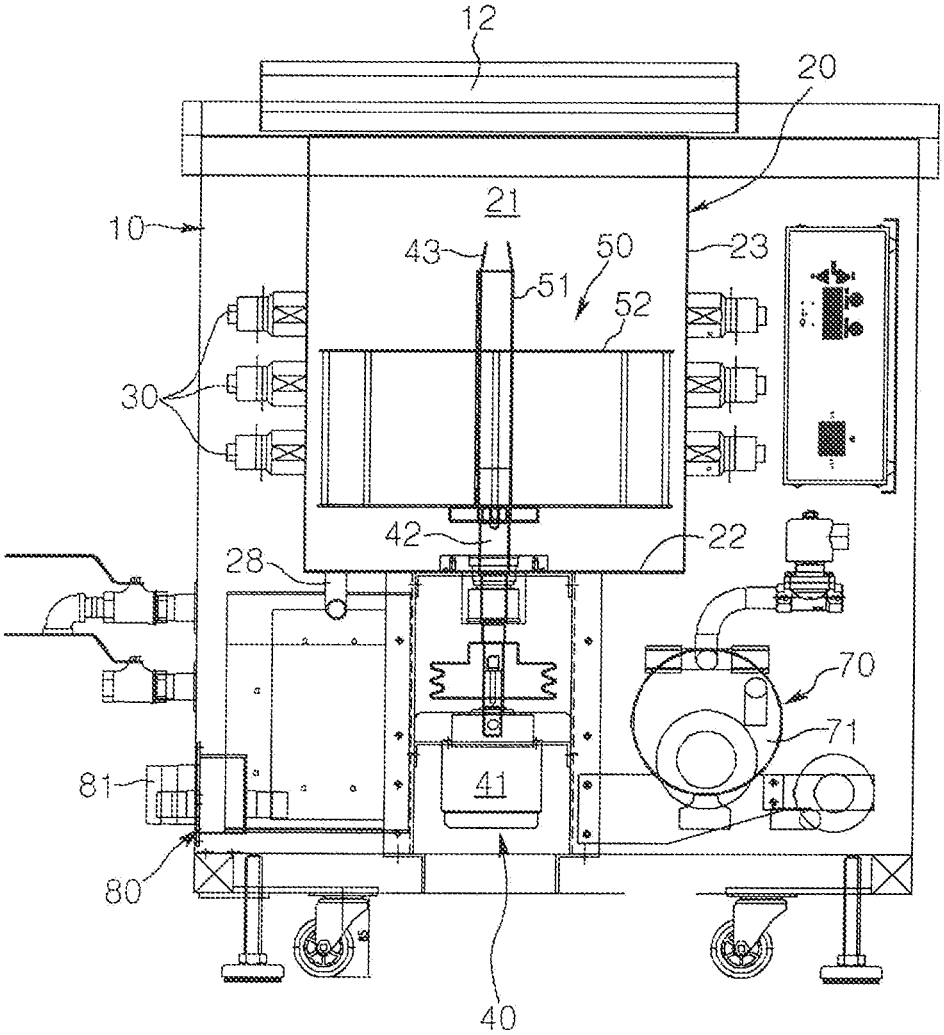

[Fig. 2]
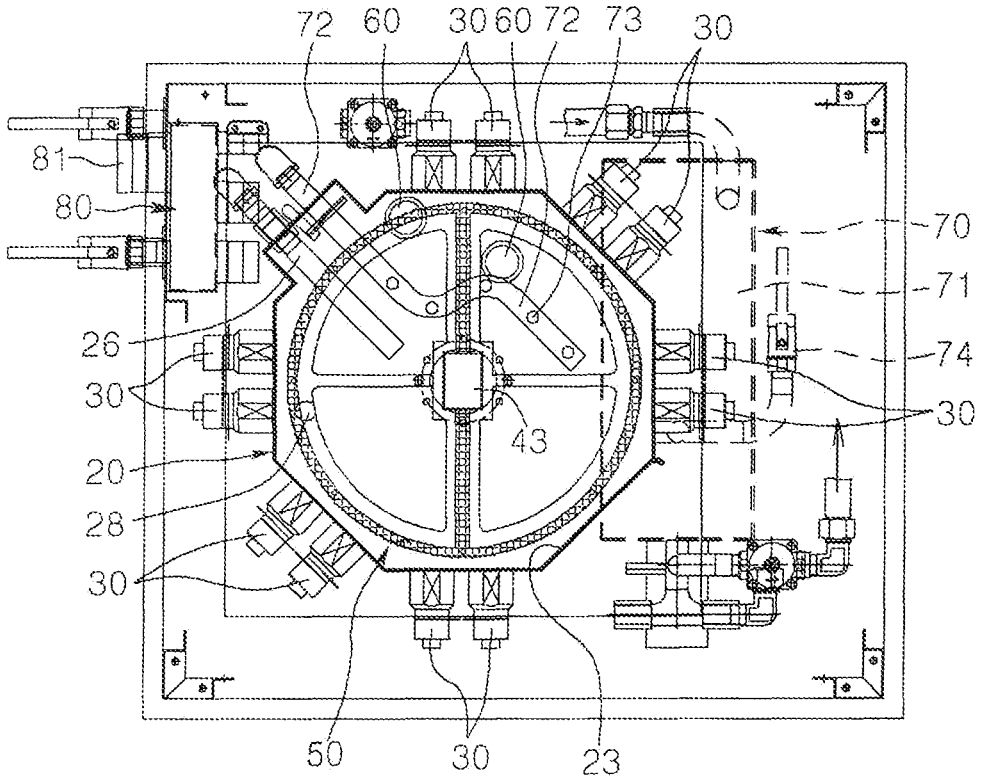

[Fig. 3]
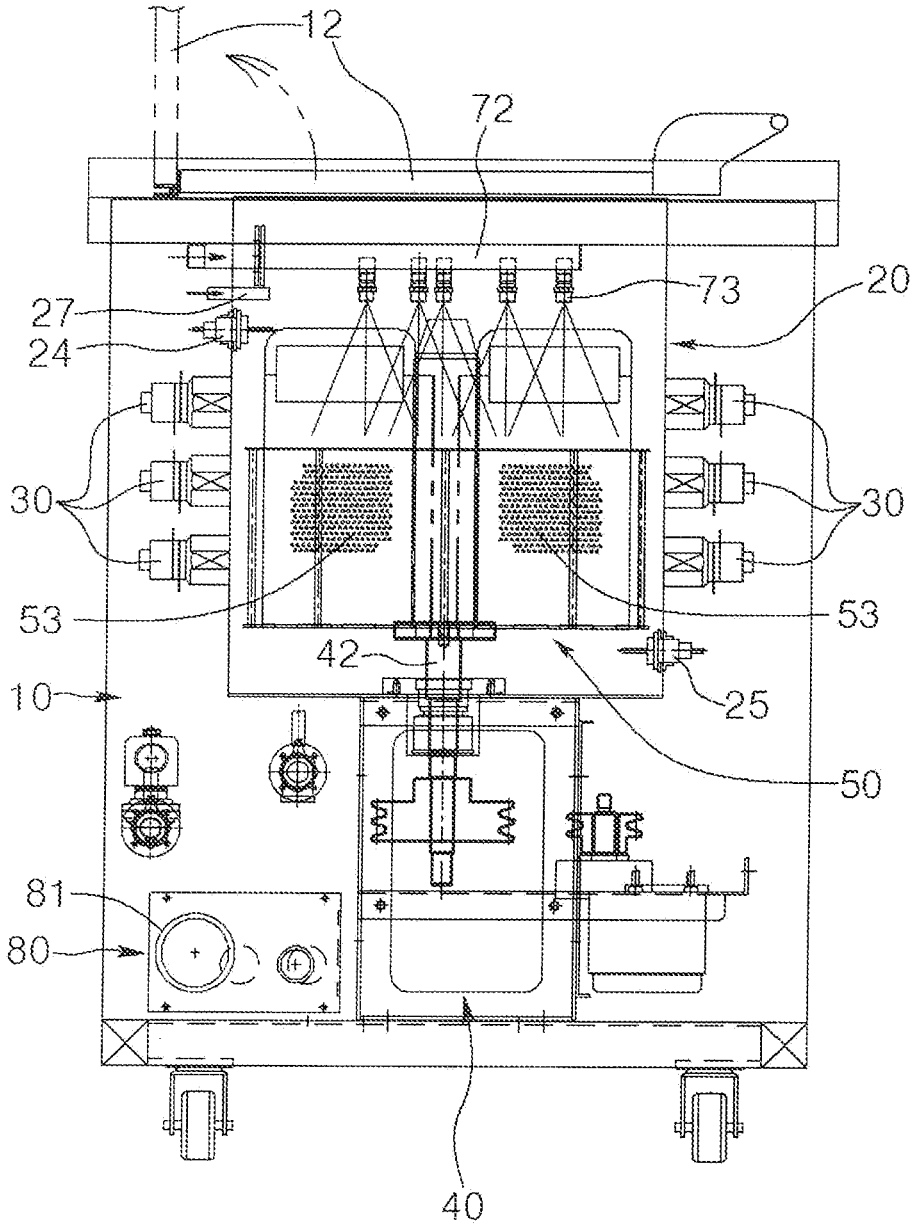

[Fig. 4]
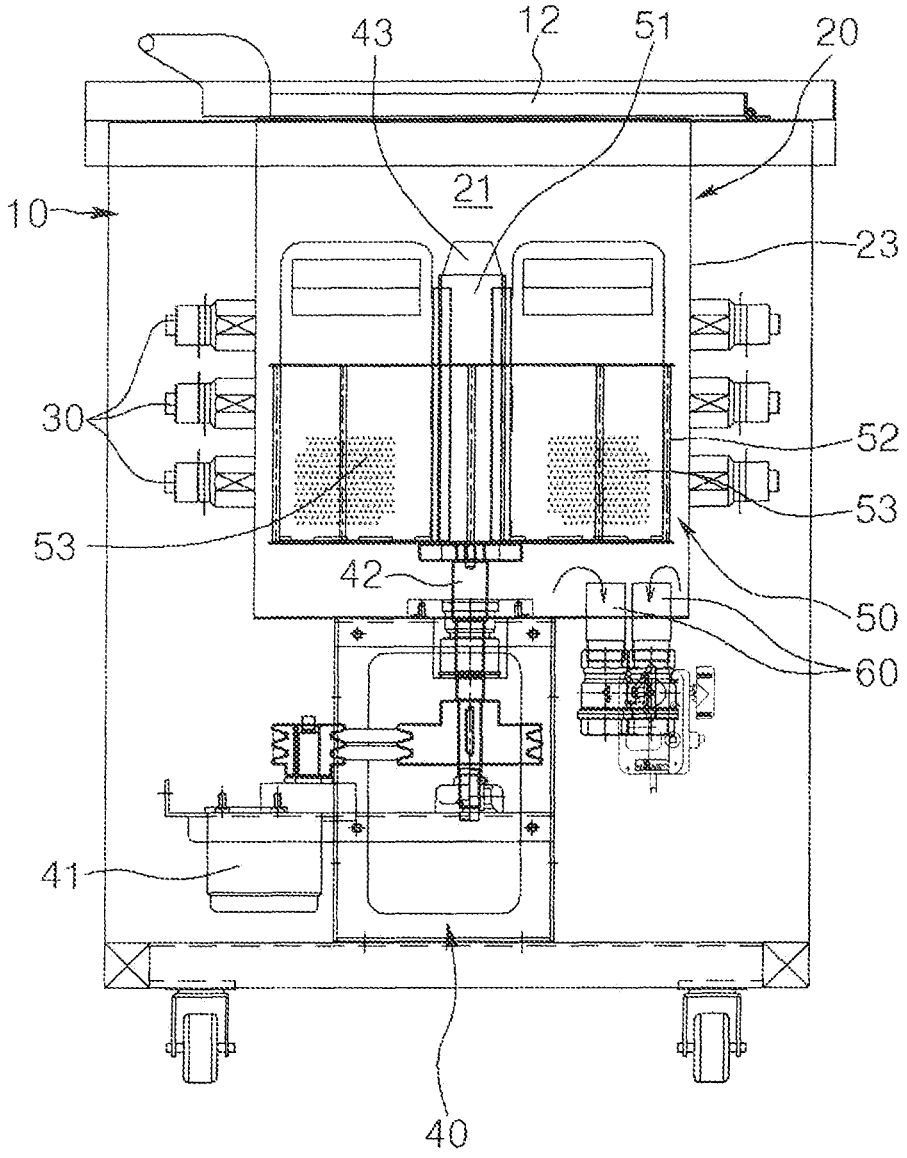

[Fig. 5]
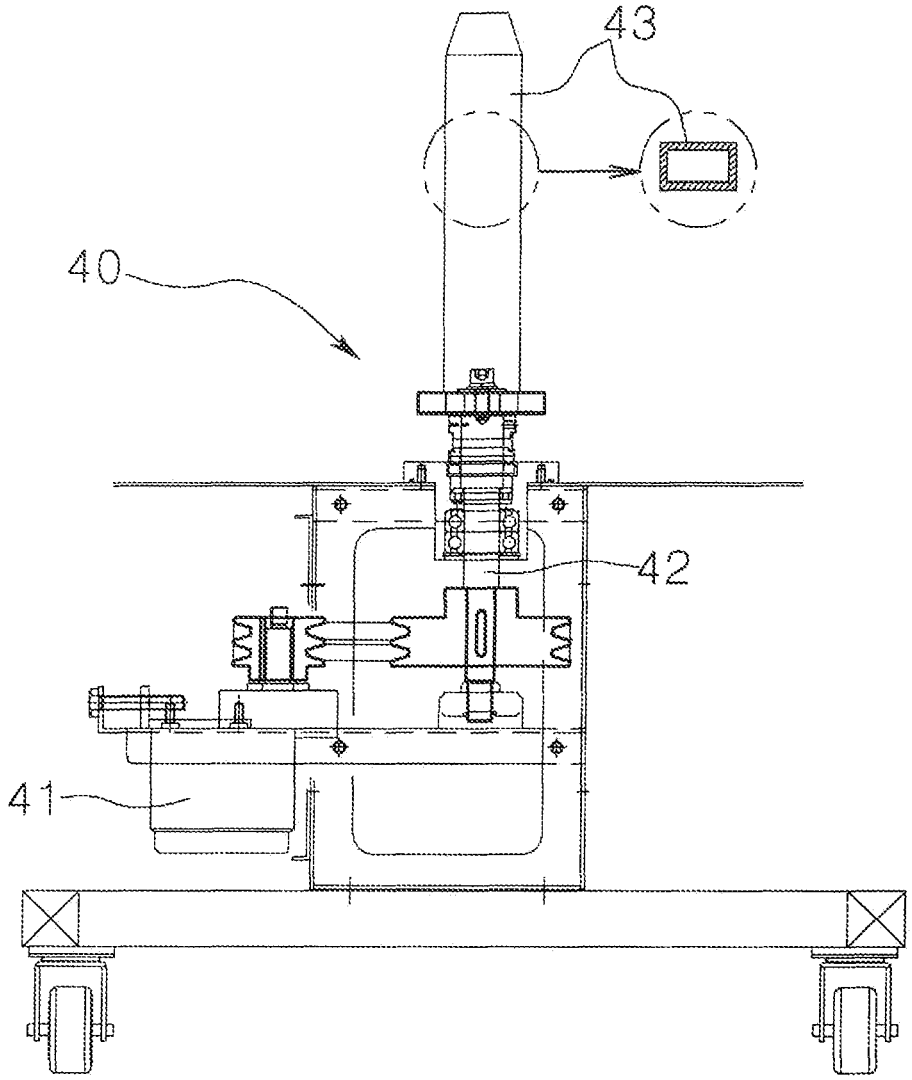

[Fig. 6]
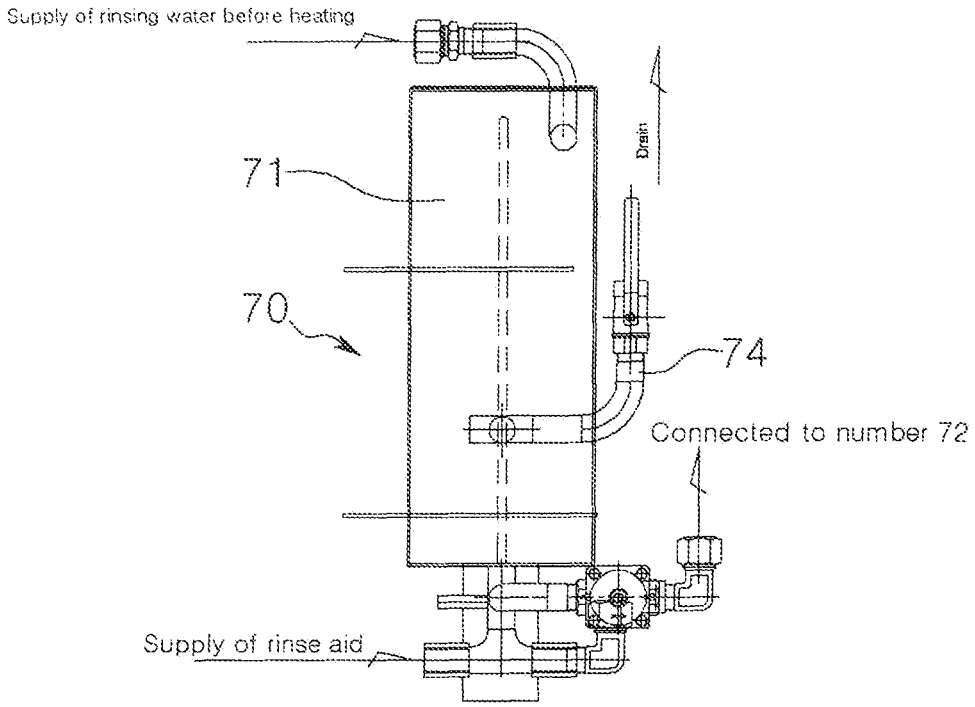

[Fig. 7]
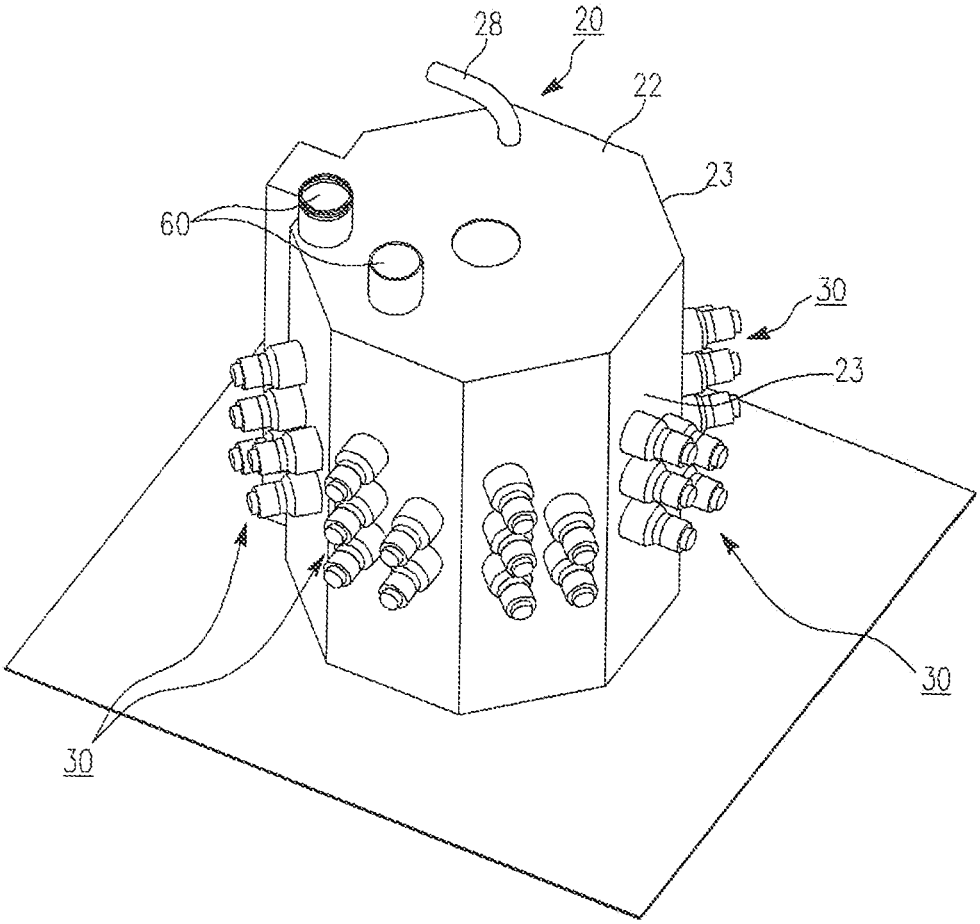

[Fig. 8a]
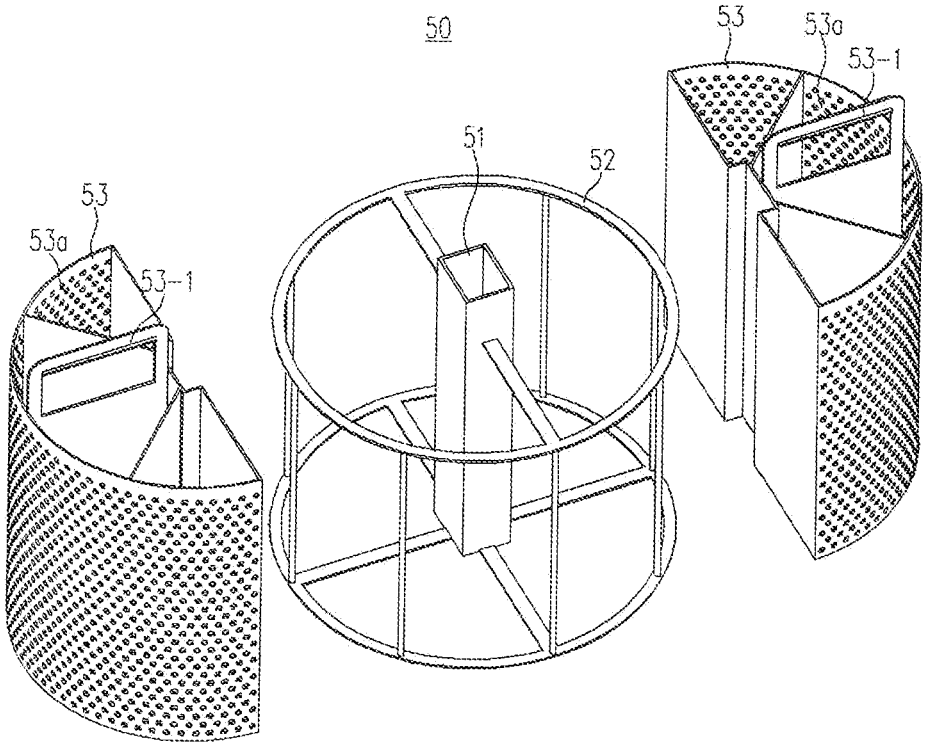

[Fig. 8b]
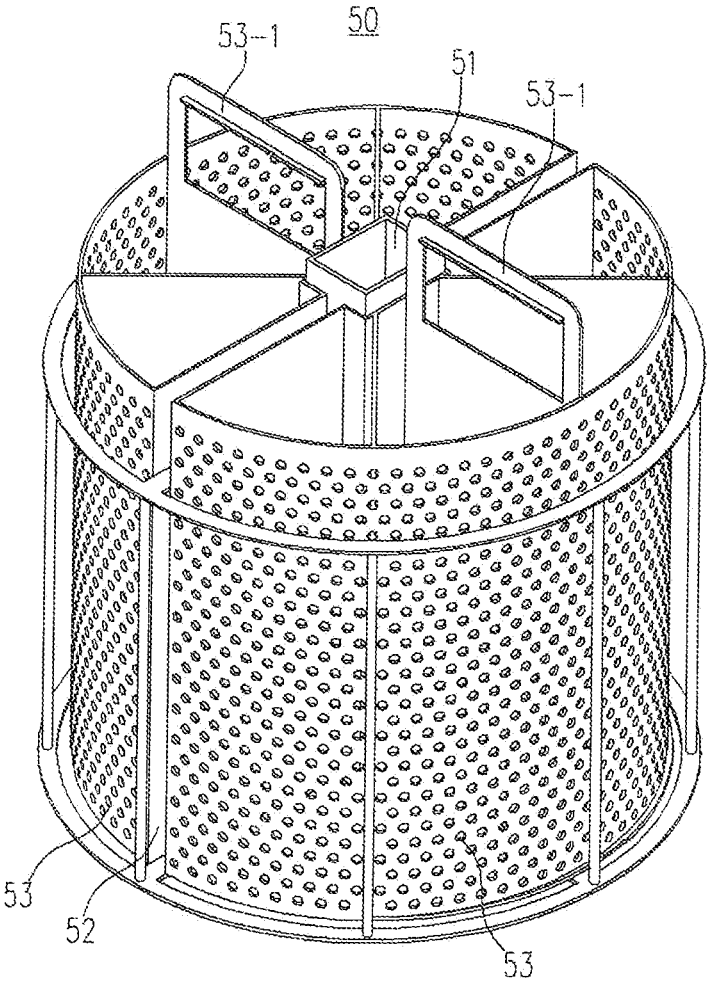

[Fig. 9a]
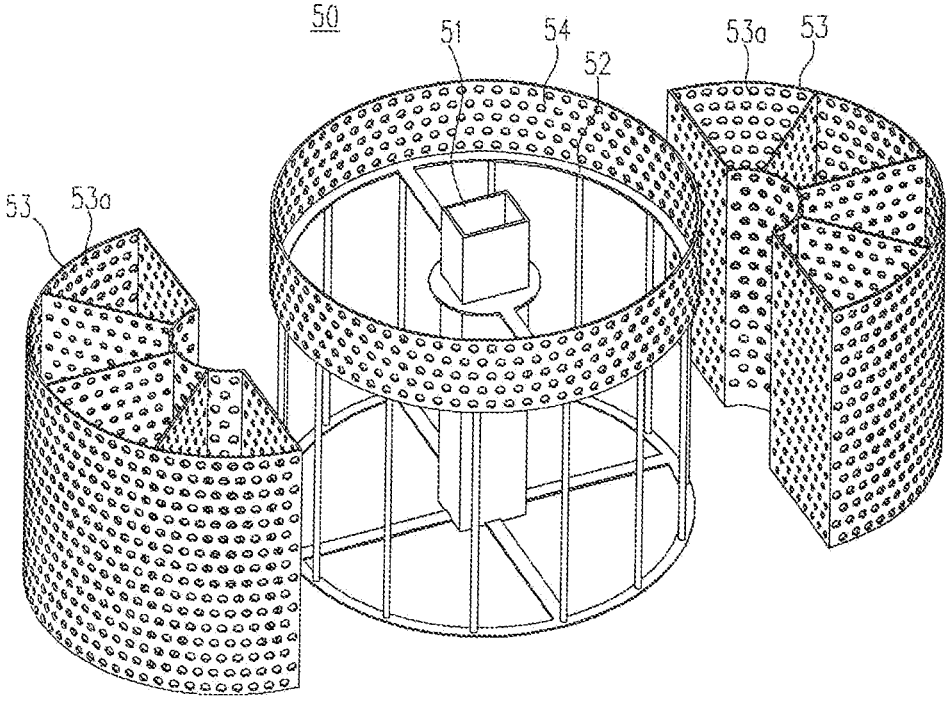

[Fig. 9b]
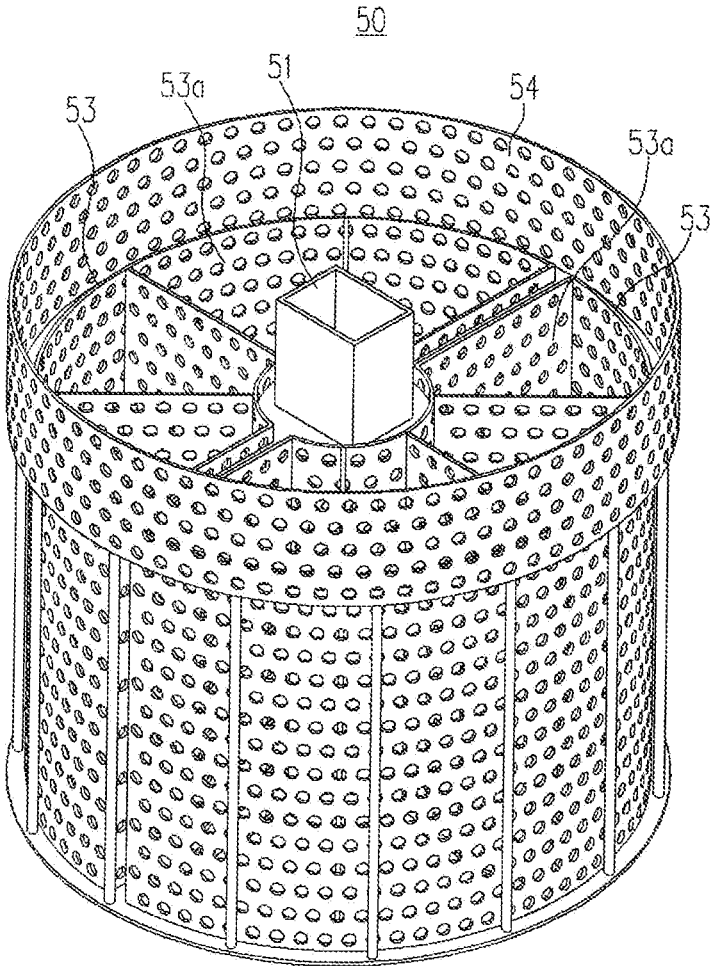

[Fig. 10a]
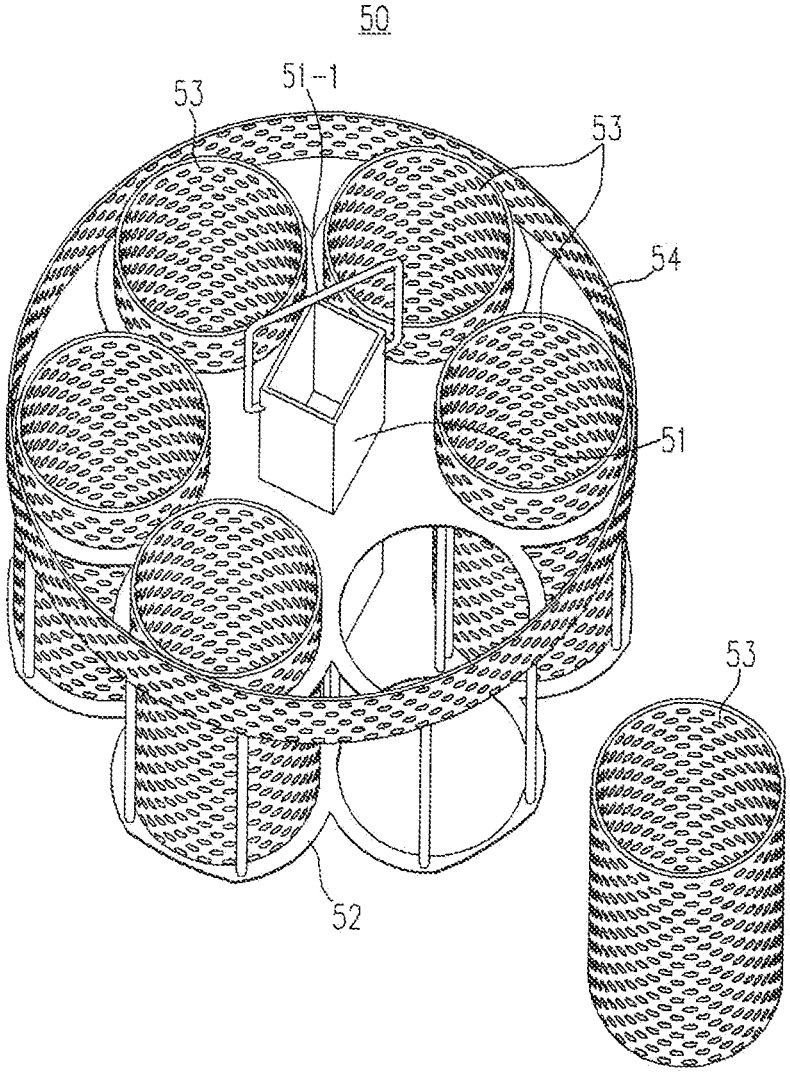

[Fig. 10b]
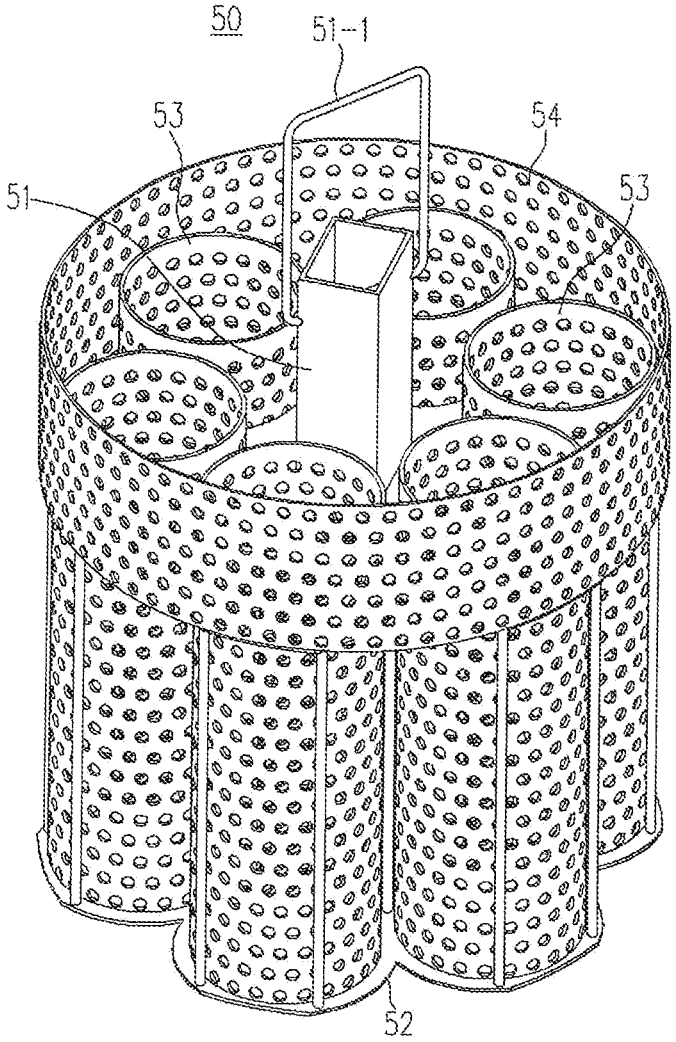

[Fig. 11]
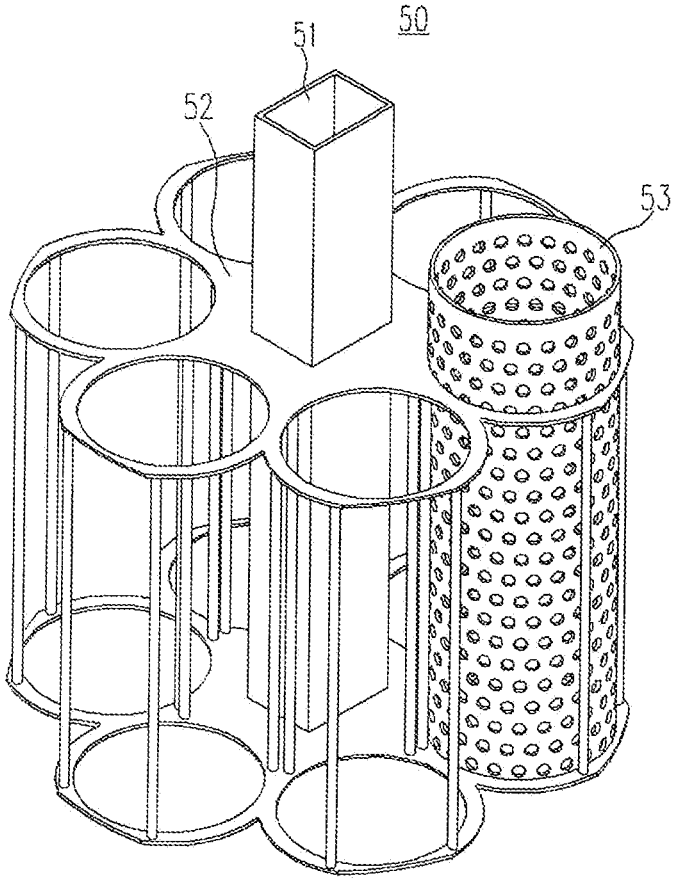

[Fig. 12]
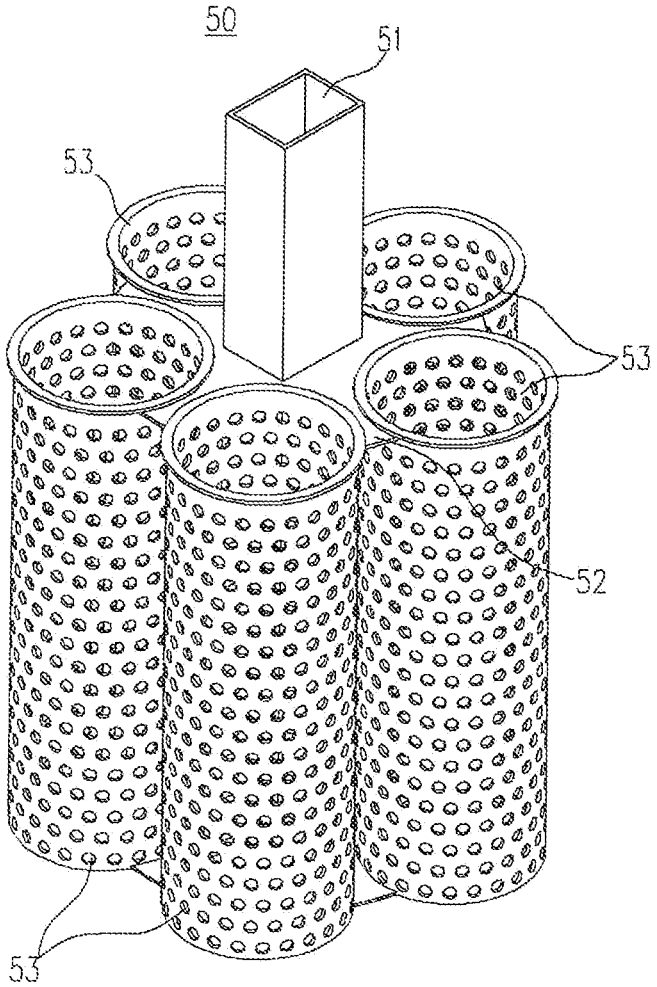

ULTRASONIC SPOON WASHING APPARATUS AND METHOD

TECHNICAL FIELD

The present disclosure relates to ultrasonic spoon washing apparatus and method, which use ultrasonic waves generated by one or more ultrasonic oscillators provided on a vertical side wall of polygonal surfaces of a wash tub so that spoons (collectively referred to as various types of "food utensils" such as spoons, chopsticks, forks, knives, and the like used to eat food) accommodated in a spoon accommodation container having a spoon support part rotating forward/in reverse maybe very efficiently and conveniently washed while the number of revolutions changes for each washing stage.

BACKGROUND ART

In general, a large amount of spoons are used in places where communal feeding is required, such as hotels, restaurants, schools, hospitals, company cafeterias, and the like where many people eat. Meanwhile, a large number of spoons used in this way take a lot of time to wash after use. That is, conventionally, spoon washing is performed manually one by one, so working efficiency is remarkably reduced due to an increase of the working time, and simple water washing is performed, causing many problems to occur in hygiene, for example, clean washing is not able to be performed.

In consideration of such points, some spoon washing machines configured to wash the spoon have been proposed conventionally, but a structure is complicated, washing water is wasted severely, and washing power is also unreliable, so use thereof has not been invigorated.

To describe more specifically, the spoon washers having been conventionally provided and used include mainly: a conveyor-type spoon washing method, in which spoons are transported by a conveyor belt on which the spoons are loaded, thereby being washed by a brush rotating at a position thereabove and by high-pressure washing water sprayed thereon; and a method in which washing water and spoons are accommodated in a wash bucket, and then the spoons are washed by oscillating the wash bucket or by spraying the high-pressure washing water from thereabove while swinging the wash bucket.

The spoon washing machines of the conveyor belt transfer method may be exemplified in Korean Patent No. 10-1288446 and Korean Patent No. 10-1330794. Here, Korean Patent Registration No. 10-1288446 is characterized in that spoons or chopsticks inserted along a slide are transported on a vertical conveyor belt, are washed while passing between upper and lower rollers with brushes formed on outer circumferential surfaces, respectively, and are discharged. In this case, a chopstick passage hole is formed in the discharge part so that only chopsticks narrower than the spoon pass through the chopstick hole, thereby separating and storing the spoons and chopsticks. Meanwhile, Korean Patent No. 10-1330794 is configured to include: a first washing part configured to emit air bubbles or ultrasonic waves to an accommodation bucket to soak and wash spoons and at the same time to immerse the spoons; a washing part configured to wash the spoons by spraying a washing liquid by injection nozzles, which are formed on upper and lower sides of the transfer conveyor and are configured to spray the washing liquid by a washing pump on an upper part of the transfer conveyor transporting the firstly washed spoons; a rinsing part formed with rinsing nozzles on the upper and lower sides of the transfer conveyor to spray a rinsing liquid and formed with a rinsing bucket on a lower side thereof; and a drying part configured to remove moisture by blowing wind on the spoons transported passing through the rinsing part. However, the spoon washing device of the conveyor transfer method as described above has drawbacks, for example, as follows: a surface that is placed on the conveyor as the spoon is transported on the conveyor, that is, the bottom of the spoon, has difficulty to contact with the washing liquid and the brushes, whereby washing power is reduced; waste of washing water due to spraying of washing water is severe; and in particular, the device is complicated due to a large number of components, and a spoon washer is enlarged, thus limiting the installation space.

In addition, as another method of washing spoons, Korean Patent No. 10-1148849 may be mentioned. In this method, a guide rail and a carriage horizontal operating bar are provided on a top part of a pedestal. Here, the carriage horizontal operating bar is fixed to one side of a carriage in a horizontal direction and passes through a horizontal guide block, wherein the carriage is disposed at an inside of a wash bucket that has the horizontal guide block on a side wall of one side thereof. Meanwhile, a motor is mounted inside the pedestal and disposed such that a direction of a motor shaft is parallel to a vertical direction. In addition, a rotating disk is fixedly installed on the motor shaft. At this point, one side of the rotating disk and the carriage horizontal operating bar passed through the horizontal guide block are coupled to each other in a movable state. The method is configured such that by performing reciprocating motion according to the horizontal stroke operation of the carriage, the spoons mounted inside the wash container are washed with washing water sprayed through nozzles, or the spoons are immersed in the washing water and washed by applying oscillations shaking into a straight line of left and right thereto. Compared to the conventional conveyor belt type, it consists of a simpler washing configuration, so there is an advantage that the product can be miniaturized. However, it is difficult to align the spoons put in the wash bucket and the spoons are washed by a relatively simple process, so the reliability of washing is reduced. Furthermore, when washing is performed by spraying washing water, there is a problem in that washing water is severely wasted.

As a way to solve some of the problems of the conventional spoon washers, recently, washing machines configured to wash various fruits or the spoons using ultrasonic waves have been proposed.

As is well known, ultrasonic washing uses a sound pressure effect of ultrasonic waves and a cavitation effect to wash by removing foreign substances attached to surfaces of various objects. The cavitation is accompanied by micro-agitation occurring according to the oscillation of the bubble and by chemical and thermal actions due to the destruction of the bubble. The combination and repetition of such reactions increase the promotion and dispersion actions of chemical reactions in the washing solution, whereby precise washing is achieved by removing foreign substances attached to the object to be washed.

Looking at the conventional ultrasonic washers that have been provided to wash spoons, Korean Utility Model No. 20-0441856 and Korean Patent No. 10-1166436 may be mentioned.

Korean Registered Utility Model No. 20-0441856 is intended to provide an ultrasonic washing device so that one ultrasonic washing device may be used in a variety of ways in a kitchen for various purposes, wherein the ultrasonic washer may be configured to be separable from a casing and may also be configured such that a spoon sterilizer box may be installed on one side and a cordless electric kettle may be used on an opposite side. In order to achieve such objectives, the ultrasonic washer is configured to wash the object to be washed by ultrasonic waves generated from the washing water during operation of the ultrasonic oscillator, the ultrasonic washer including: an ultrasonic washing box provided with a washing room, which has one openable lid and is configured to receive the washing water, wherein a drain hole, which is to be opened to the outside and configured to drain the washing water, is installed in addition to the ultrasonic oscillator, at a bottom of the washing room; a casing detachably coupled to the ultrasonic washing box, provided with a drain pipe coupled to communicate with the drain hole at an inside thereof, and also provided with a control panel, which is configured to operate the ultrasonic oscillator and installed on a front surface thereof; and a connection means configured to electrically connect the ultrasonic oscillator to the control panel by being installed at portions facing the casing and the ultrasonic washing box, respectively.

In addition, Korean Patent No. 10-1166436 is intended to improve a washing efficiency of spoons by allowing washing to be automatically performed according to an operation of the ultrasonic sensor while rotating of the spoons is performed by inserting the spoons into a separate rotation container. In order to achieve such objectives, an ultrasonic washing machine is configured to include: an inner water tub provided at an upper portion of a washing machine body to accommodate washing water at a predetermined level; a spoon accommodation container configured to be rotatable with a rotation shaft as a center inside the inner water tub and formed in a cylindrical shape formed with a plurality of perforations on an outer wall surface; a driving motor mounted on one side of the washing machine body to transmit a rotational force to the spoon accommodation container; and a plurality of ultrasonic sensors configured to generate ultrasonic waves by being provided on a bottom surface of the inner water tub.

However, in all of the above-described conventional ultrasonic washing machines, the ultrasonic washing operation is performed on the material to be washed in a state in which the ultrasonic oscillators or the ultrasonic sensors are installed on the floor of the washing room or inner water tub. Therefore, as the ultrasonic waves are always generated in one direction, the washing efficiency is lowered and inefficient, and as the washing machines have an unnecessary volume, it is difficult to avoid structural problems that result in a large amount of water consumption.

DISCLOSURE

Technical Problem

Accordingly, the present disclosure has been made keeping in mind the above problems occurring in the prior art, and an objective of the present disclosure is to provide an ultrasonic spoon washing apparatus and method. In the present disclosure, an inside of a wash tub is formed with a vertical sidewall of polygonal surfaces to minimize a volume with respect to a spoon support part installed to rotate forward/in reverse inside the wash tub, and at the same time, ultrasonic oscillations are generated in various directions through one or more ultrasonic oscillators installed on each surface of the vertical side wall to be disposed close to the support part. Accordingly, the apparatus and method are capable of minimizing waste of washing water and maximizing a washing efficiency.

Another objective of the present disclosure is to provide the ultrasonic spoon washing apparatus and method that are capable of further maximizing convenience and efficiency of the washing in such a way that the spoons to be washed in the wash tub are washed step-by-step by water and ultrasonic waves in a state of being placed in the spoon accommodation container of the spoon support part and are allowed to be dried after rinsing.

Technical Solution

In order to accomplish the above objectives, there may be provided an ultrasonic spoon washing apparatus according to the present disclosure, the apparatus including: a frame body; a wash tub which is mounted inside the frame body, of which a vertical side wall of polygonal surfaces extends upward around a bottom surface thereof so that a washing space having a predetermined depth is provided, in which washing water is automatically supplied and blocked through a washing water supply part controlled by means of highest and lowest water level detection sensors, and in which a detergent is also automatically supplied and blocked through a detergent supply part; one or more ultrasonic oscillators provided on an outer side of the vertical side wall comprising the polygonal surfaces of the wash tub; a forward/reverse rotation support part mounted vertically in a center of an inside of the wash tub so as to be rotatable forward/in reverse and comprising a support shaft axially installed by passing through to an inside of the wash tub in order to rotate forward/in reverse through power transmitted from a motor and a rotation support pipe installed vertically inside the wash tub in order to rotate forward/in reverse with respect to the support shaft, wherein the rotation support pipe is formed of polygon so as to rotate forward/in reverse together with the spoon support part mounted thereon without rotating idle one another when the spoon support part rotates forward/in reverse; a spoon support part comprising a holder for detachably supporting a fitting pipe so as to be rotatable forward/in reverse with respect to the rotation support pipe of the forward/reverse rotation support part and a spoon accommodation container supported and mounted inside the holder so as to be withdrawable therefrom; a rinsing water supply part configured to spray, after ultrasonic spoon washing using the washing water and washing water draining, the rinsing water, having been heated to a proper temperature (80~85° C.) in a rinsing tank, together with a rinsing aid from above a top of the spoon support part rotating forward/in reverse through at least one nozzle formed in an injection pipe so as to rinse the spoons that have been completely washed; and a wastewater and foreign material discharge part configured to discharge, to the outside, the wastewater and foreign materials generated during a spoon washing and rinsing process, wherein the wastewater and foreign materials discharged in the process of washing and rinsing the spoon, respectively, are collected in one water collecting pipe through the drain pipes connected to the wash tub and the rinsing tank of the rinsing water supply part, respectively, including the wastewater and foreign material discharge part, and are discharged to the outside through one discharge pipe.

According to the present disclosure, the vertical side wall of polygonal surfaces of the wash tub may be made within a range of a hexagonal shape to a dodecagonal shape.

According to the present disclosure, the forward/reverse rotation support part may be configured to rotate forward/in reverse at a medium speed during washing with washing water and detergent, at a low speed during ultrasonic washing, at a medium speed during rinsing, and at a high speed during drying according to a washing step of the spoons placed in a spoon accommodation container of the spoon support part that is supported and mounted thereon.

According to the present disclosure, the wastewater and foreign material discharge part may be installed passing through a bottom part of the wash tub in a state in which one end thereof positioned inside the wash tub protrudes by a predetermined height from a bottom of the wash tub.

According to the present disclosure, the spoon accommodation container of the spoon support part may be divided in a state of being half and configured to be supportedly mounted to be withdrawable with respect to the holder, and the spoon accommodation container may be partitioned into at least one accommodation space.

According to the present disclosure, each spoon accommodation container of the spoon support part may be individually divided and supportedly mounted to be withdrawable, with respect to the holder.

According to the present disclosure, each spoon accommodation container of the spoon support part may be divided individually but integrally fixedly installed, with respect to the holder.

According to the present disclosure, the fitting pipe and the spoon accommodation container of the spoon support part may further be provided with a handle for detaching manipulation and a handle for pulling-out, respectively.

According to the present disclosure, the holder of the spoon support part may further be provided with a safety net on a top side thereof.

There may be provided an ultrasonic spoon washing method according to the present disclosure, the method including: primarily washing the spoons placed in the spoon accommodation container using washing water and detergent, while washing water and an appropriate amount of the detergent are supplied to the wash tub having a vertical side wall made of polygonal surfaces, and at the same time, the spoon support part, which is detachably mounted on the rotation support pipe of the forward/reverse rotation support part, is rotated forward/in reverse at a medium speed; secondarily washing the spoons using ultrasonic waves, wherein, when the washing water in the wash tub reaches the highest water level, the spoon support part, mounted on the rotation support pipe of the forward/reverse rotation support part, is rotated forward/in reverse from a medium speed to a low speed and, at the same time, the ultrasonic oscillators, mounted on the outside of the vertical sidewall of the wash tub, are operated; discharging the wastewater including the foreign materials in the wash tub to the outside through the wastewater and foreign material discharge part after the primarily and secondarily washing of the spoons is completed; rinsing the spoons accommodated in the spoon accommodation container by rotating the spoon support part forward/in reverse at the medium speed at the same time when draining of the wastewater and foreign materials are completed through the wastewater and foreign material discharge part, wherein, at the same time, in a state in which the wastewater and foreign material discharge part is open, the rinsing water, which has been heated to a high temperature (80-85° C.) in the rinsing tank of the rinsing water supply part, is sprayed evenly together with the appropriate amount of the rinsing aid from above the top of the spoon support part through at least one nozzle formed in an injection pipe; and drying the spoons while rotating the spoon support part forward/in reverse at the high speed again so that the water attached to the spoon accommodated in the spoon accommodation container is removed after the rinsing is completed.

Advantageous Effects

As described above, according to the present disclosure, the vertical side wall of the wash tub is formed of polygonal surfaces to allow the ultrasonic oscillators to be disposed close with respect to the spoon support part, so that ultrasonic waves are generated in various directions at positions close to the spoon support part through one or more ultrasonic oscillators installed on the polygonal surfaces and, at the same time, a volume inside the wash tub is minimized, thereby minimizing an amount of washing water consumption while maximizing washing efficiency.

According to the present disclosure, the effect to increase the efficiency of spoon washing step-by-step can be provided by varying the forward/reverse rotation speed of the spoon support part installed rotatably in a forward/reverse direction in the wash tub according to the washing step.

According to the present disclosure, drying is allowed to take place through a process in which the spoon support part is rotated at a high speed after ultrasonic cleaning and rinsing, thereby providing the effect of allowing spoons to be used immediately after taking out the spoons from the spoon support part without a separate water removal operation.

According to the present disclosure, through a structure of the spoon accommodation container or a structure of a handle for pulling-out of the spoon support part, it is possible to easily make the spoon arrangement for washing and to conveniently perform the external withdrawal operation of the spoon accommodation container or a holder before and after washing.

According to the present disclosure, by collecting and discharging various kinds of wastewater or foreign materials in one water collecting pipe, it is possible to provide an advantage of simplifying a system for discharging the wastewater or foreign materials.

DESCRIPTION OF DRAWINGS

FIG. 1 is a view showing a front structure according to the present disclosure.

FIG. 2 is a view showing a top surface structure according to the present disclosure.

FIG. 3 is a view showing a left side structure with reference to FIG. 1 according to the present disclosure.

FIG. 4 is a view showing a right side structure with reference to FIG. 1 according to the present disclosure.

FIG. 5 is an extracted view showing a structure of a forward/reverse rotation support part according to the present disclosure.

FIG. 6 is an extracted view showing a structure of a rinsing water supply part according to the present disclosure.

FIG. 7 is an extracted view showing a structure of a rear surface of a wash tub according to the present disclosure.

FIGS. 8A and 8B are views showing disassembled and assembled states of a spoon support part, respectively, according to an embodiment of the present disclosure.

FIGS. 9A and 9B are views showing disassembled and assembled states of a spoon support part, respectively, according to another embodiment of the present disclosure.

FIGS. 10A and 10B are views showing disassembled and assembled states of a spoon support part, respectively, according to still another embodiment of the present disclosure.

FIG. 11 is a view showing an assembled state of the spoon support part according to still another embodiment according to the present disclosure.

FIG. 12 is a view showing an assembled state of the spoon support part according to still another embodiment according to the present disclosure

BEST MODE

Hereinafter, exemplary embodiments according to the present disclosure will be described in more detail with reference to the accompanying drawings.

With reference to FIGS. 1 to 12, a spoon washing apparatus according to the present disclosure largely includes a frame body 10, a wash tub 20, ultrasonic oscillators 30, a forward/reverse rotation support part 40, a spoon support part 50, a wastewater and foreign material discharge part 60, and a rinsing water supply part 70.

The frame body 10 is equipped with various devices and may be equipped with a movement prevention device having a function of preventing arbitrary movement or of height adjustment when equipment is completed, including wheels for movement, at a lower portion thereof.

The wash tub 20 is mounted inside the frame body 10. The wash tub 20 has a vertical side wall 23 of polygonal surfaces extendedly formed upward with a bottom surface 22 as a center so as to provide a washing space 21 having a predetermined depth and has a shape open upward.

In addition, the wash tub 20 may be covered with a cover 12 that is connected to the frame body 10 and configured to be manipulated to be opened and closed in one direction.

In the present disclosure, the reason for forming the vertical side wall 23 of the wash tub 20 in polygonal surfaces is not only to facilitate installation of the ultrasonic oscillator by sufficiently taking into account that it is considerably difficult to mount the ultrasonic oscillator 30 on a curved surface when the wash tub 20 is formed in a circular type but also to reduce a volume with respect to the circular-type spoon support part 50 mounted inside the wash tub 20 to a minimum. Accordingly, this enables efficient washing while reducing wasting of washing water.

To this end, the vertical side wall 23 may be made of a polygonal shape within a range of between a hexagonal shape and a dodecagonal shape. In addition, it may be an octagonal shape as best. The reason is that by configuring the vertical side wall 23 in the octagonal shape, there is a structural advantage in that a volume of the washing space may be minimized by allowing the wall to be close to the spoon support part 50 made of a circular type. In addition, when the vertical side wall is formed to have no greater than a pentagonal shape, there is a problem in that an unnecessary volume in the wash tub 20 is provided compared to the shape of the spoon support part 50, thereby causing waste of washing water.

In the washing space 21 of the wash tub 20, washing water is automatically supplied and blocked through a washing water supply part 26 configured to be controlled by means of highest and lowest water level detection sensors 24 and 25, and an appropriate amount of detergent is automatically made to be supplied and blocked through the detergent supply part 27. The appropriate amount of detergent supplied through the detergent supply part 27 may be controlled to be supplied and blocked by a timer.

The washing water supply part 26 and the detergent supply part 27 are disposed on any one surface of the vertical side wall made of polygonal surfaces. At this time, the washing water supply part 26 configured to supply and block the washing water to the washing space 21 may be installed to be disposed above the highest water level detection sensor 24, whereby the washing water is supplied from the uppermost side of the washing space 21.

The ultrasonic oscillators 30 configured to generate ultrasonic waves are mounted on outer peripheral surfaces of the vertical side wall 23 of the wash tub 20. One or more ultrasonic oscillators may be installed on each surface other than the surface on which the washing water supply part 26 is disposed.

The ultrasonic oscillators 30 disposed outside the polygonal surfaces of the vertical side wall 23 may be variously installed according to working conditions.

The ultrasonic oscillators 30 may be installed on the surfaces of the vertical side wall 23 opposite to each other so that the ultrasonic waves are generated in directions facing each other, but not limited thereto, and may be selectively installed as needed.

In the case of the present disclosure, except for the surface on which the washing water supply part 26 is disposed and the surface corresponding thereto so that ultrasonic spoon washing is performed, at least six ultrasonic oscillators 30 are mounted on each of the remaining surfaces of the vertical side wall 23 (see FIG. 2).

When mounting the ultrasonic oscillators 30 on the outside of the corresponding surfaces of the vertical side wall 23 made of the polygonal surfaces as described above, respectively, as the ultrasonic waves are generated at various angles, the efficiency of the ultrasonic spoon washing may be remarkably increased as compared to conventional ultrasonic waves that are limitedly generated in only one direction.

Inside the wash tub 20, a rotation support pipe of the forward/reverse rotation support part 40 is axially installed so as to be rotatable forward/in reverse.

The forward/reverse rotation support part 40 includes: a support shaft 42 axially installed by passing through to an inside of the wash tub 20 in order to rotate forward/in reverse through power transmitted from a motor 41; and a rotation support pipe 43 installed vertically inside the wash tub in order to rotate forward/in reverse with respect to the support shaft. In this case, the rotation support pipe 43 may be formed in a polygonal shape so as to rotate forward/in reverse together with the spoon support part 50, which is supported and mounted thereon, without rotating idle one another when the spoon support part 50 rotates forward/in reverse.

According to the present disclosure, the rotation support pipe 43 of the forward/reverse rotation support part 40 is configured to be controlled according to a washing step of the spoons placed in a spoon accommodation container of the spoon support part 50 that is supported and mounted thereon. That is, the rotation support pipe 43 is controlled to rotate forward/in reverse at a medium speed during washing with washing water and detergent, at a low speed during ultrasonic washing, at a medium speed during rinsing, and at a high speed during drying.

Here, a forward/reverse rotation speed of the rotation support pipe 43 may be set approximately at 20 to 30 times per minute in the case of the medium speed, 5 to 10 times in the case of the low speed, and 50 to 60 times in the case of the high speed.

Therefore, according to the present disclosure, it becomes possible to make that in a process of first washing the spoons by adding the washing water or detergent, the spoon support part 50 is rotated forward/in reverse at the medium speed for the first washing, for second washing using the ultrasonic waves, the spoon support part 50 is rotated at the low speed to maximize an effect of washing foreign materials by the ultrasonic waves, during rinsing, the spoon support part 50 is rotated forward/in reverse at the medium speed again to perform rinsing, and during drying, the spoon support part 50 is rotated forward/in reverse at the high speed to forcibly remove moisture from the spoons.

The spoon support part 50 includes: a holder 52 in which a fitting pipe 51 is detachably supported to be rotatable forward/in reverse with respect to the rotation support pipe 43 of the forward/reverse rotation support part 40; and a spoon accommodation container 53 supportedly mounted inside the holder to be withdrawable.

The holder 52 and the spoon accommodation container 53 of the spoon support part 50 are composed of a structure that allows the foreign materials generated by friction with the washing water or ultrasonic oscillations during the washing and washing process of the spoons to be discharged. In particular, the spoon accommodation container 53 may be formed of a perforated structure, but may also be formed of a mesh-type structure as necessary.

Therefore, the above-described spoon support part 50 may be implemented in various ways within a range that does not deviate from a use thereof, and the embodiments are as follows.

The spoon accommodation container 53 of the spoon support part 50 according to the present disclosure is divided in a state of being half and configured to be supportedly mounted with respect to the holder 52, as illustrated in FIGS. 8A and 8B, and FIGS. 9A and 9B, and to be partitioned to have at least one accommodation space 53*a* at the inside thereof.

In addition, each spoon accommodation container 53 of the spoon support part 50 according to the present disclosure may be supportedly mounted to be withdrawable individually with respect to the holder 52, as illustrated in FIGS. 10A and 10B, and FIG. 11.

In addition, according to the present disclosure, each spoon accommodation container 53 of the spoon support part 50 may be configured individually but integrally fixedly installed with respect to the holder 52, as illustrated in FIG. 12.

On the other hand, according to each embodiment of the present disclosure, the spoon accommodation container 53 of the spoon support part 50 may further be provided with a handle 53-1 for pulling-out.

By having the handle 53-1 for pulling-out, it is possible to more conveniently perform pulling out manipulation of the spoon accommodation container 53 from the holder 52.

In addition, according to each embodiment of the present disclosure, the fitting pipe 51 of the spoon support part 50 may further be provided with a handle 51-1 for detaching manipulation.

By further having the handle 51-1 for detaching manipulation, it will be possible to more conveniently perform detaching manipulation of the holder 52 from the wash tub 20 when the holder 52 is pulled out after the washing operation.

In addition, according to each embodiment of the present disclosure, the holder (52) of the spoon support part (50) is further provided with a safety net (54) on a top side thereof.

The safety net 54 may play a role of preventing the spoons from leaving to the outside due to shaking during the forward/reverse washing process when a height of a top end of the spoon accommodation container 53 mounted on the holder 52 is mounted in a relatively low state.

According to the present disclosure, the wastewater and foreign material discharge part 60 is to discharge the wastewater or the foreign materials in the wash tub 20 to the outside after the first washing operation with washing water and the second washing operation by the ultrasonic oscillations are performed. To this end, the wastewater and foreign material discharge part 60 is installed passing through a bottom part of the wash tub in a state in which one end thereof positioned inside the wash tub protrudes by a predetermined height from a bottom of the wash tub. The wastewater and foreign material discharge part (60) may be installed with at least one for rapid discharge.

At this time, since the wastewater and foreign material discharge part 60 is disposed in a state in which the one end thereof protrudes from the bottom surface 22 of the wash tub 20 by the predetermined height, the bottom of the wash tub is always filled with a certain amount of water unless the wastewater is finally drained through a drain pipe 28. In particular, such a point serves to induce a smooth rotation operation by preventing the through-assembly part of the forward/reverse rotation support part 40 installed to penetrate inside the washtub 20 from drying out.

According to the present disclosure, the rinsing water supply part 70 is configured, in a state in which foreign materials or wastewater is discharged through the wastewater and foreign material discharge part 60 after washing by the washing water and ultrasonic waves, to spray rinsing water heated to a proper temperature (80-85° C.) in the inside of a rinsing tank 71 together with a rinsing aid through at least one of nozzles 73 formed in an injection pipe 72 from above the spoon support part 50 rotating forward/in reverse, thereby rinsing the spoons having been completely washed.

In the drawing, reference numeral 28, which is not described, denotes a drain pipe installed through the bottom of the wash tub 20, and 74 denotes a drain pipe provided in the rinsing tank 71.

Therefore, the spoons placed in the spoon accommodation container 53 of the spoon support part 50 and completely washed collides with the rinsing water while the spoon support part 50 rotates forward/in reverse, and various foreign substances are removed again, and wastewater or foreign materials generated in the rinsing process are discharged to the outside through the wastewater and foreign material discharge part 60 being in an open state.

Therefore, in the ultrasonic spoon washing apparatus according to the present disclosure configured as described above, the washing water and detergent are fed into the wash tub 20 through the washing water supply part and the detergent supply part 27, while the forward/reverse rotation support part 40 rotates. The spoon support part 50 mounted on the support pipe 43 rotates forward/in reverse at the medium speed, whereby the spoons accommodated in the spoon accommodation container 53 of the spoon support part are first washed. In addition, when the washing water is filled to the highest water level by means of the highest water level detection sensor 24 in the wash tub, the spoon support part 50 rotates forward/in reverse at the low speed by the forward/reverse rotation support part 40, and at the same time, by generating ultrasonic waves from the ultrasonic oscillators 30 mounted on the outside of the vertical side wall 23 made of polygonal surfaces of the wash tub, the spoons accommodated in the spoon accommodation container 53 of the spoon support part 50 are secondarily washed by the ultrasonic waves.

Here, ultrasonic oscillators are equipped on the vertical side wall 23 of the wash tub 20 made of polygonal surfaces, so the spoons to be secondarily washed by ultrasonic oscillations may be evenly washed by ultrasonic waves generated from various directions and angles.

In addition, when the first and second washing by the washing water and ultrasonic waves is completed, the foreign materials or wastewater remaining in the wash tub are discharged to the outside through opening of the wastewater and foreign material discharge part 60, and at the same time, the rinsing water, which is heated to a high temperature (80-85° C.) in the rinsing tank 71 of the rinsing water supply part 70, is sprayed from above the top of the spoon support part 50 together with an appropriate amount of the rinsing aid (rinse). At this time, the spoon support part 50 rotates forward/in reverse at the medium speed to evenly rinse the spoons accommodated in the spoon accommodation container 53.

When wastewater and foreign materials generated in the rinsing process are also discharged to the outside through the wastewater and foreign materials discharge part 60 being in an open state, and rinsing by the rinsing water is completed, the spoon support part 50 is rotated forward/in reverse at the high speed again by the forward/reverse rotation support part 40, and the water on the spoons is forcibly dried through this operation.

In addition, when the drying operation of the spoons is completed, the cover 12 is opened from the frame body 10, and then the spoon accommodation container 53 is pulled out from the holder 52 of the spoon support part 50 to use the spoons.

Therefore, the spoons accommodated in each spoon accommodation container 53 accommodated in the holder 52 of the spoon support part 50 through a series of processes as described above may be automatically washed, and after washing and rinsing are completed, the drain pipes 28 and 74 are opened to wash the inside of the wash tub and the rinsing tank.

According to the present disclosure, it may be configured such that the wastewater and foreign materials, which are discharged through the drain pipes 28 and 74 connected to the wash tub 20 and the rinsing tank 71, respectively, and the wastewater and foreign material discharge part 60 in the process of washing and rinsing the spoon, may be connected to each other and thus collected in one water collecting pipe 80 so as to be finally discharged to the outside through one discharge pipe 81. By doing so, there is an advantage in that it is possible to more easily and simply manage the discharge of the wastewater and foreign materials.

Next, an ultrasonic spoon washing method according to the present disclosure is looked at as follows.

According to the washing method of the present disclosure, the spoons accommodated in the spoons accommodation container 53 of the spoon support part 50 are automatically washed through the followings, the washing method including: primarily washing the spoons placed in the spoon accommodation container (53) using washing water and detergent, while washing water and an appropriate amount of the detergent are supplied to the wash tub (20) having a vertical side wall (23) made of polygonal surfaces, and at the same time, the spoon support part (50), which is detachably mounted on the rotation support pipe (43) of the forward/reverse rotation support part (40), is rotated forward/in reverse at a medium speed;

secondarily washing the spoons using ultrasonic waves, wherein, when the washing water in the wash tub (20) reaches the highest water level, the spoon support part (50), mounted on the rotation support pipe (43) of the forward/reverse rotation support part (40), is rotated forward/in reverse from a medium speed to a low speed and, at the same time, the ultrasonic oscillators (30), mounted on the outside of the vertical sidewall (23) of the wash tub, are operated;

discharging the wastewater including the foreign materials in the wash tub (20) to the outside through the wastewater and foreign material discharge part (60) after the primarily and secondarily washing of the spoons is completed;

rinsing the spoons accommodated in the spoon accommodation container by rotating the spoon support part (50) forward/in reverse at the medium speed at the same time when draining of the wastewater and foreign materials are completed through the wastewater and foreign material discharge part (60), wherein, at the same time, in a state in which the wastewater and foreign material discharge part (60) is open, the rinsing water, which has been heated to a high temperature (80-85° C.) in the rinsing tank (71) of the rinsing water supply part (70), is sprayed evenly together with the appropriate amount of the rinsing aid from above the top of the spoon support part (50) through at least one nozzle (73) formed in an injection pipe (72); and drying the spoons while rotating the spoon support part (50) forward/in reverse at the high speed again so that the water attached to the spoon accommodated in the spoon accommodation container (53) is removed after the rinsing is completed.

In addition, after the washing operation of the spoons is completed, the cover 12 of the frame body is opened, and then the spoon accommodation container 53 of the spoon support part 50 mounted on the rotation support pipe of the forward/reverse rotation support part 40 is pulled out to the outside to use the spoons.

In the ultrasonic washing method of the spoons, the forward/reverse rotation speed of the forward/reverse rotation support part 40 on which the spoon support part 50 is mounted may be set approximately to 20 to 30 times per minute in the case of the medium speed, to 5 to 10 times per minute in the case of the medium speed, and to 50 to 60 times per minute in the case of the high speed.

Through the method as described above, the spoons are washed over two times through the washing water and ultrasonic oscillations, and at the same time, a process of rinsing and drying is automatically performed after washing. In such a process, more efficient washing of the spoons may be achieved by varying the forward/reverse rotation speed of the spoon support part.

Although the present disclosure has been described with reference to the accompanying drawings, the present disclosure is not limited thereto, and it is natural that many modifications and changes may be made without departing from the scope of the following claims.

The invention claimed is:

1. An ultrasonic spoon washing method, the method comprising the steps:

providing a spoon accommodation container (53) and a wash tub (20);

inserting the spoon accommodation container (53) into the wash tub (20);

primarily washing spoons placed in the spoon accommodation container (53) using washing water and detergent supplied to the wash tub (20) having a vertical sidewall (23) made of a polygonal surface, and at the same time, a spoon support part (50), which is detachably mounted on a rotation support pipe (43) of a forward/reverse rotation support part (40), is rotated forward/in reverse at a first speed to rotate the spoons while primarily washing;

secondarily washing the spoons using ultrasonic waves, wherein, when the washing water in the wash tub (20) reaches a first water level, the spoon support part (50) is rotated forward/in reverse from the first speed to a second speed to rotate the spoons while secondarily washing and, at the same time, ultrasonic oscillators (30), mounted on an outside of the vertical sidewall (23) of the wash tub, are operated to provide said ultrasonic waves;

draining wastewater including foreign materials outside of the wash tub (10) through a wastewater and foreign material discharge part (60) after the primarily and the secondarily washing of the spoons are completed;

rinsing the spoons accommodated in the spoon accommodation container by rotating the spoon support part (50) forward/in reverse at the first speed at the same time while draining the wastewater and the foreign materials through the wastewater and foreign material discharge part (60), wherein, in a state in which the wastewater and foreign material discharge part (60) is open, rinsing water, which has been heated to a temperature of 80-85 C in a rinsing tank (71) of a rinsing water supply part (70), is sprayed evenly together with an amount of a rinsing aid from above a top of the spoon support part (50) through at least one nozzle (73) formed in an injection pipe (72); and drying the spoons while rotating the spoon support part (50) forward/in reverse so that the rinsing water attached to the spoons accommodated in the spoon accommodation container (53) is removed after the rinsing is completed.

* * * * *